United States Patent [19]

Karnis et al.

[11] 4,292,122

[45] Sep. 29, 1981

[54] BONDING PROPERTIES OF MECHANICAL PULPS

[75] Inventors: Alkibiadis Karnis; John R. Wood, both of Montreal, Canada

[73] Assignee: Domtar Inc., Montreal, Canada

[21] Appl. No.: 890,186

[22] Filed: Mar. 27, 1978

Related U.S. Application Data

[63] Continuation-in-part of Ser. No. 747,878, Dec. 6, 1976, abandoned.

[51] Int. Cl.[3] ..... D21B 1/14

[52] U.S. Cl. ..... 162/28; 162/55; 209/17

[58] Field of Search ..... 162/28, 55; 241/24, 241/28; 209/17, 211

[56] References Cited

U.S. PATENT DOCUMENTS

| | | | |
|---|---|---|---|
| 3,085,927 | 4/1963 | Pesch | 162/55 |
| 3,352,745 | 11/1967 | Malm | 162/55 |
| 3,372,879 | 3/1968 | Jones et al. | 241/24 |
| 3,411,720 | 11/1968 | Jones et al. | 162/26 |

FOREIGN PATENT DOCUMENTS

| | | | |
|---|---|---|---|
| 2335014 | 1/1975 | Fed. Rep. of Germany | 162/28 |

*Primary Examiner*—William F. Smith

[57] ABSTRACT

Process for producing a mechanical pulp of improved linting properties by screening the pulp to provide a through and a retained fraction, fractionating the through fraction by means of a hydrocyclone into at least two fractions one fraction having an average specific surface less than a predetermined value between 1.2 and 4 $m^2/g$ and the second fraction having an average specific surface greater than the first fraction and subjecting the first fraction to mechanical processing thereby to form a processed fraction having an average specific surface of 4 to 10 $m^2/g$ and recombining said process fraction and said second fraction into a combined pulp.

The invention also relates to a method of determining specific surface distribution of fibres of the mechanical pulp by fractionating the pulp in a hydrocyclone system into a plurality of underflow fractions and a plurality of overflow fractions each of said underflow and overflow fractions containing a different portion of fibres of said sample and analyzing each of said underflow fractions or of said overflow fractions or both to determine the specific surface of each of said selected underflow or overflow fractions.

4 Claims, 7 Drawing Figures

BONDING PROPERTIES OF MECHANICAL PULPS

This application is a continuation-in-part of application Ser. No. 747,878 filed Dec. 6, 1976 now abandoned.

FIELD OF THE INVENTION

The present invention relates to a method of improving the properties of a mechanical pulp and a paper made therefrom. It relates particularly to a method of reducing the linting tendencies of such pulp and thereby improving the printing properties of such paper.

BACKGROUND OF THE INVENTION

By mechanical pulps are understood pulps produced primarily by mechanical processing with or without auxiliary steps of a chemical or physical nature. Such pulps include conventional (stone) groundwood and refiner groundwood and pulps produced by an array of chemi-mechanical and thermo-mechanical processes. Such pulps generally have lower bonding properties than chemical pulps and conventionally have been used, e.g. in the making of newsprint, with substantial admixtures of chemical pulp. The tendency has been to reduce more and more such admixtures of chemical pulp and even to use mechanical pulp alone. This trend has been greatly encouraged by the development of the more recent processes of thermo-mechanical and chemi-mechanical pulping and the improvements in the properties of the resulting pulps.

However, the surface properties of paper produced from furnishes of preponderantly mechanical fibers often present problems, particularly accenuated in connection with changes in printing technology, such as the growing acceptance of off-set printing. One such problem is "linting" i.e. the phenomenon of fibers being picked out of the sheet in the process of printing and accumulating on the printing press. Related phenomena are scuffing and dusting and also "picking" in both, wet and dry webs; and in most cases where the term "linting" is used, it is meant to cover all these related phenomena. A high linting propensity of the paper or newsprint will be a nuisance to the printer and in certain cases may cause the paper to be rejected by the customer.

The linting propensity and the associated other deficiencies of the paper are essentially a surface phenomenon and are due to the relatively weak bonding of and between certain fibers on or close to the surface of the paper. As such, the phenomenon is connected in some way with the type of paper machine, the condition of forming, draining and so on. But on any given machine there will still be differences between paper obtained at different times and these differences are accounted for primarily by the pulps used.

It has been proposed to reduce the linting of paper by applying adhesive materials to the surface of the paper, however, this procedure adds considerably to the expenses and is not always effective.

It is, of course, known to beat or refine a pulp to lower its freeness and develop strength and bonding properties, however, mechanical pulps of quite low freeness often still exhibit the phenomenon of linting; moreover, refining the pulp beyond a certain limit will degrade its properties and will also lengthen the drainage time beyond what is acceptable in the papermaking operation. Lower freeness is generally associated with higher average specific surface of the pulp, and generally as would logically be expected leads to a better bonded paper, yet pulps having substantially the same average specific surface often have different linting properties and some pulps of quite low freeness (high average specific surface) produce paper which still lints badly.

It is known to separate from a pulp a "reject" fraction by means of a hydrocyclone and to subject such "rejects" to further refining, but such fractions are generally very small and consist of the relatively unrefined or unfiberized particles.

Malm (U.S. Pat. No. 3,352,745) uses a hydrocyclone to separate a chemical pulp into a springwood fraction and a summerwood fraction, however, Malm's pulp being a chemical unbeaten pulp, the separation is on the basis of coarseness and the method is directed to the achieving of objectives entirely different from those of the present invention. Pesch (U.S. Pat. No. 3,085,927) teaches a process substantially similar to Malm.

Jones (U.S. Pat. Nos. 3,372,879 and 3,411,720) makes a mechanical pulp by means of a refiner having special sinusoidally grooved plates, separates the pulp by screening into an acceptable pulp and non-acceptable wood material, separates the rejected material by hydrocyclone into a coarse fraction and a less coarse fraction, and subjects each fraction to refining, the intensity of refining depending on the coarseness of the fraction. Jones' process is clearly directed to making a mechanical pulp of overall improved strength, by applying to the pulp in total substantially more horse power than is ordinarily done, but it will not selectively reduce linting: on the contrary, by initially separating the pulp on the basis of fiber lengths into about two halves and selecting the shorter fibers as the accepted pulp, Jones from the start includes in his accepted pulp fraction the major part of the fibres which, as will be explained below, from the main source of "lint."

The specific surface as commonly defined expresses the ratio of the surface of the fibers of their weight, e.g. in square meters per gram, and as referred to herein, is obtained using the Robertson & Mason method described in "Specific Surface of Cellulose Fibres by Liquid Permeability Method" Pulp & Paper magazine of Canada, page 103, Dec. 19, 1949.

BRIEF DESCRIPTION OF THE INVENTION

We have now found experimentally that the tendency of lint (insofar as it is caused by the characteristics of the pulp and not by those of the paper machine) is connected not with the overall or "average" value of specific surface of the pulp but with the fractional distribution of the fibres of different specific surface in the pulp more particularly with the amount of short fiber material (1 mm and less) of low specific surface. This distinction is important, the same average value of specific surface may result from the summation of values which are all close to the average or also values which deviate widely from an average towards both extremes. A pulp may have a high average specific surface yet, if it contains a substantial fraction of low specific surface material particularly low specific surface short length fibrous material it will have a tendency to lint significantly. To reduce the linting propensity it is necessary to reduce the amount of low specific surface, short fiber length material in the pulp.

It is preferred to improve both linting and strength characteristics of a pulp and therefore it is preferred to separate substantially all of the pulp on the basis of specific surface into a low specific surface fraction and a higher specific surface fraction and to apply energy to the low specific surface fraction, thereby to increase the specific surface of substantially all the low specific surface fibers and thereby increase the strength or the bonding characteristics of the pulp while improving the linting propensity.

Accordingly, the present invention broadly provides a process for reducing the linting propensity of a mechanical pulp and the linting of paper made therefrom in which said pulp is fractionated into at least two fractions, one of said fractions having a specific surface lower than the other fraction and contains low specific surface short length fibers, said fraction of lower specific surface is separated and subjected to mechanical processing thereby to increase the specific surface thereof, and the processed fraction is recombined with said other fraction.

The present invention more specifically provides a process wherein substantially all of a mechanical pulp is fractionated by a hydrocyclone means into at least two fractions, one of said fractions having a selected average specific surface value between 1.2 and 4 $m^2/g$ and the other fraction having a specific surface greater than said one of said fractions, said one of said fractions is subjected to mechanical processing thereby to increase the specific surface to above 4 and generally to not above 10 $m^2/g$ and said mechanically processed fraction is recombined with said other fraction.

Alternatively, if the added energy is to be held to an absolute minimum, and substantially only the linting propensity is to be improved, then substantially all of the mechanical pulp need not be fractionated in a hydrocyclone. Rather, the pulp may be first screened so that a significant portion of those fibers having a fiber length about 1 mm or less are accepted and the accepts then separated in a hydrocyclone to produce a fraction having a short length of up to 1 mm and a specific surface value of between 1.2 and 4 $m^2/g$. This fraction is mechanically processed to significantly increase its specific surface and then recombined with the remainder of the pulp to form a combined pulp having a lower linting propensity than the initial pulp. It must be borne in mind that with average or conventional mechanical pulps such as groundwood or thermo-mechanical pulps over about ½ the fibers fall in the length catagory of 1 mm or less and thus the energy saving in processing only the low specific surface short fibers (1 mm or less) material is limited.

The present invention also broadly relates to a method of determining specific surface distribution of the fibre in a mechanical pulp by fractionating in a hydrocyclone system to provide a plurality of overflow and underflow fractions and analyzing at least some of said fractions to determine the specific surface of the selected fractions.

BRIEF DESCRIPTION OF THE DRAWINGS

The invention will be further illustrated by means of the attached drawings in which.

DETAILED DESCRIPTION OF THE INVENTION

Figure 1:
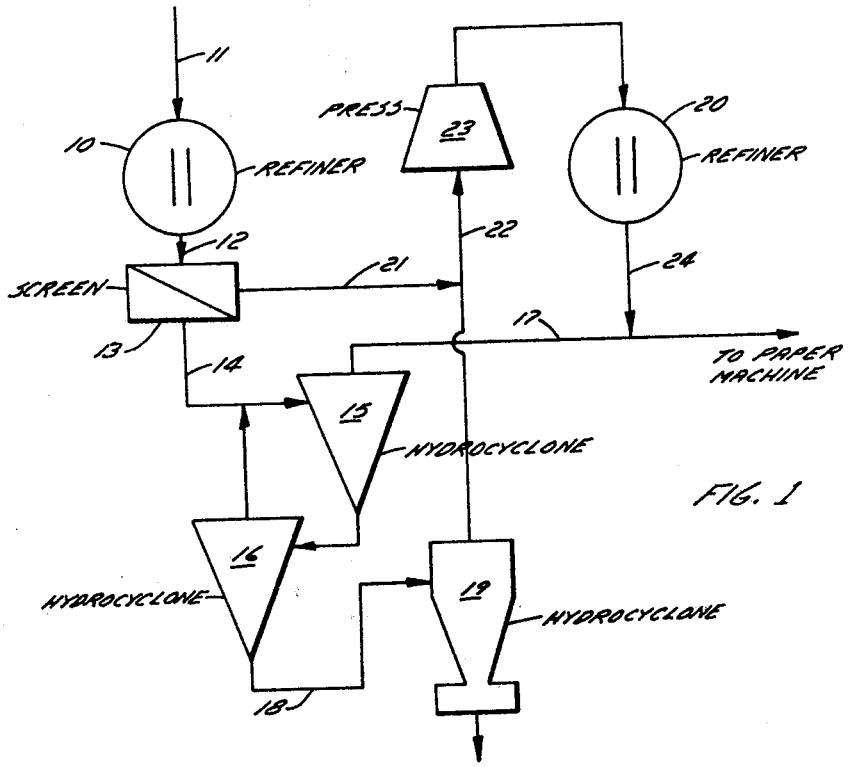
FIG. 1 represents a schematic flow sheet of one embodiment of the invention integrated with a refiner ground mill operation.

According to the invention, a mechanical pulp, e.g. one produced from wood fragments in a refiner, is divided into at least two fractions, one being characterized by a low specific surface and containing low specific surface short length material, and this fraction is passed through a second refiner. The fractionation of the pulp on the basis of specific surface is conveniently achieved by means of hydrocyclones. These are familiar devices in the pulp and paper industry where they have been used for many years to remove from pulp a "reject" fraction, usually consisting of shives, fiber bundles and heavy particles. Usually the "rejects" from the cyclones are kept as low as possible; in mechanical pulp they rarely exceed about 10% of the pulp. Normally the material rejected by the cleaners in a conventional system would have an average specific surface of about 0.8 to 1, and would not exceed 1.2 $m^2/g$.

Fractionation by means of hydrocyclones takes place on the basis of various physical and geometrical characteristics of the fibers but we have found that for mechanical pulps the predominant measurable characteristic which differentiates the "overflow" from the "underflow" fraction issuing from a hydrocyclone is the specific surface. (By "underflow" fraction is understood the fraction issuing from the apex and the hydrocyclone). Accordingly, in the present invention, the pulp is passed into a hydrocyclone or a set of hydrocyclones adapted to produce an underflow fraction having a specific surface not exceeding a certain value; the overflow fraction will then have a value higher than said value. The value of specific surface which is thus chosen as criterion may vary, depending on how exacting are the specifications for the paper, the latter in turn depending, among others, on the method of printing to be used, the type of ink and so on.

It has been found by studying lint obtained from a blanket of a commercial offset printing press from a printing job of medium difficulty (two color, medium tack ink) that the lint fibers have an average specific surface of approximately 2.5 $m^2/g$ and a length of 1 mm or less. This average specific surface for lint fibers would change depending on the difficulty of the printing job but normally is within a range of about 1 to 4 $m^2/g$. In all cases individual lint fibers will be present having specific surfaces above and below the average value, however, the lint material will not be expected to contain significant numbers of fibers with specific surfaces more than about 1 $m^2/g$ above the average specific surface of the lint material for a given paper machine and printing operation since material of this increased specific surface would tend to bond into the sheet. Based on these findings it was determined that to improve the lint qualities of a paper or a pulp those fibers with the low specific surface and a length of less than 1 mm must be further worked by mechanically refining so that the amount of lint candidate material in the pulp for the specific application for which the paper is intended would be reduced to acceptable limits. Preferably substantially all of the pulp will be fractionated so that the low specific surface fraction contains low specific surface fibers of all lengths.

Hydrocyclones are generally set to fractionate a pulp into fractions according to a ratio of underflow to overflow fractions, such ratios being determined by the geometrical features of the hydrocyclone (relative sizes of input to output openings, cone angle etc.) as well as the conditions of operation (pressure, consistency). With the present invention the hydrocyclones will be set to produce an underflow fraction of an average specific surface in the range of 1.2–4 $m^2/g$ preferably 1.5–4 $m^2/g$ is separated. The size of this fraction will necessarily vary with the conditions of pulping, type of wood, etc. In the case of refiner groundwood and in the freeness range within which most refiner plants operate, the underflow fraction will amount to between 15–70% preferably 25–50% of the total pulp. The desirable size of the underflow fraction may be determined in the mill by varying the reject rate and determining the linting of the paper produced or by preliminary tests in the laboratory, e.g. by multiple fractionation of a sample of the pulp using a hydrocyclone and measuring the average specific surface of each fraction to obtain the specific surface distribution of the fibers in the sample. A method for determining the fractional distribution of specific surface in a mechanical pulp will be described in more detail hereinbelow.

The underflow fraction is passed through a refiner where it is subjected to sufficient refining to increase the average specific surface by at least 2 $m^2/g$ preferably to bring its specific surface to a value of at least equal to that of the initial pulp and even more preferably to a value equal to or above that of the overflow fraction generally to a value of between 4–10 $m^2/g$. Refined underflow fraction is then recombined with the overflow fraction and the recombined pulp of improved properties is further processed as desired in a conventional manner and forwarded to the paper machine.

Referring to FIG. 1, wood chips, or other comminuted cellulosic raw material, are fed through line 11 to refiner 10 in which the chips are mechanically disintegrated to form a pulp. Refiner 10 represents diagramatically a refiner plant, which may be operated in any of the known ways and may thus include features which are not specifically shown in the figure but are known in the art, such as presteaming the chips, maintaining the requisite pressure in an enclosure around the refiner or otherwise controlling the conditions of refining, chemical treatment accompanying any of the stages of refining and so on. The resulting mechanical pulp is usually passed to a tank (not shown) for latency development and also to dilute the pulp to a suitable consistency and is conveyed through line 12 to screen 13 which rejects oversize particles or particularly long fibers in a conventional manner. The rejects constituting generally about 5–10% of the pulp are removed through line 21, and can further be processed, if desired. The portion of the pulp which passes through the screens is passed through line 14 into hydrocyclones, e.g. Centricleaners sold by C-E Bauer Company, which fractionate the pulp into an overflow fraction removed from the hydrocyclones via line 17 and an underflow fraction removed via line 18. A two stage hydrocyclone fractionating system is shown, represented respectively by hydrocyclones 15 and 16, but a single stage or a multiple stage system greater than two stage may be used. The overflow fraction in line 17 is the accepted fraction of the pulp having the requisite specific surface distribution; as mentioned it will constitute about 30–85% of the pulp passed through the screens. The underflow fraction in line 18 is the fraction of low average specific surface (1.2 to 4 $m^2/g$) and will constitute about 15–70% of the pulp (after the screen). The underflow fraction is then cleaned, if desired, in hydrocyclone 19 (Magnacleaner) to remove, in a conventional way, dirt and other alien particles ("grit") and the thus cleaned underflow fraction is passed through line 22 where, if desired, is combined with the screen rejects from line 21. Obviously, the cleaning by means of a Magnacleaner may be omitted, if no cleaning is necessary, and similarly the underflow fraction need not be combined with the screen rejects if it is preferred to treat these streams separately. The underflow fraction from line 22 is then thickened, e.g. in a press 23, to a consistency suitable for refining in a refiner and passed into refiner 20 where it is refined to an acceptable average specific surface value, preferably one substantially equal to the specific surface of the overflow fraction in line 17. The pulp from refiner 20 is conveyed through line 24 and, either directly mixed with the pulp in line 17 or subjected to further treatment before the paper machine.

Figure 2:
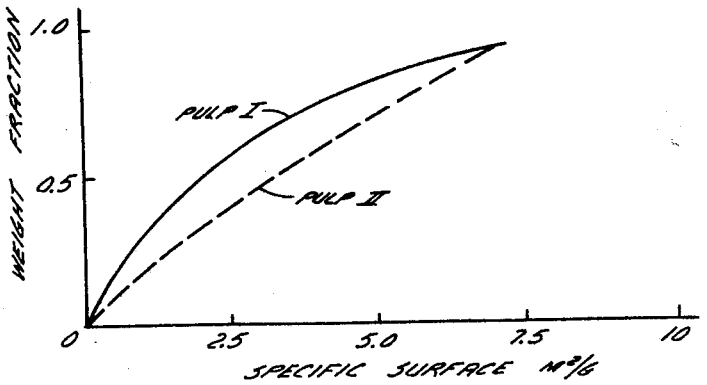
FIG. 2 represents the specific surface distribution of fibers in a pulp, the curve being a plot of specific surfaces versus weight fraction (in % of total pulp)
Figure 3:
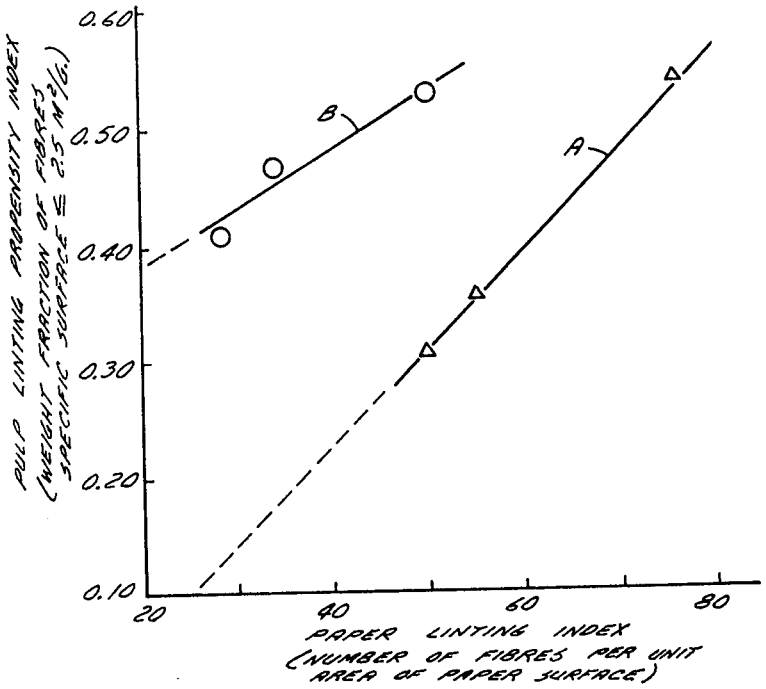
FIG. 3 represents the relationship between the linting propensity of a pulp and the presence in the pulp of a fraction of low specific surface.

The fractional distribution of specific surface in a thermo-mechanical pulp, i.e. the percentage by weight of fractions having a given specific surface, is shown in FIG. 2. Both Pulp I and Pulp II are samples collected from line 12 in FIG. 1, but they differ as to fractional distribution of specific surface, Pulp I containing close to 60% of fibers of a specific surface of 2.5 or less, while Pulp II has about 40% of such low specific surface fibers. In fact, Pulp I has a much higher linting propensity. The linting propensity is measurable by means of a simple apparatus, similar in principle to a printing press, in which the lint picked out from the sheet of paper is collected under controlled conditions and subsequently weighed or otherwise measured to establish the relative proportion of fibers so picked out from the sheet. This procedure permits the comparison of the degree of linting of various papers by means of a linting index, the latter being expressed in terms in weight or number of fibers (lint) picked out from the sheet per unit area of the paper. The direct relationship existing between the weight of a low specific surface fraction in the pulp, e.g. less than 2.5 $m^2/g$, (which we shall call "the linting propensity index") and the linting index of the paper, is shown in FIG. 3. This is a plot of the linting propensity index (weight fraction of fibers which specific surface of equal to a less than 2.5 $m^2/g$ against the paper linting index (number of linting fibers per unit area of paper surface). Curve B provides such a plot for one particular paper machine and curve A for a second machine. The values on the vertical axis represent the fraction (as measured by the method described hereinbelow) of the fibers in various thermo-mechanical pulps having an average specific surface of 2.5 $m^2/g$ or less, while the values on the horizontal axis represent the paper linting index. It can be seen that, while for different paper machines the same relative content of low specific surface fibers may result in different values of the paper linting index, for any given paper machine the paper linting index is in a direct relationship to the content of such low specific surface fibers.

Figure 4:
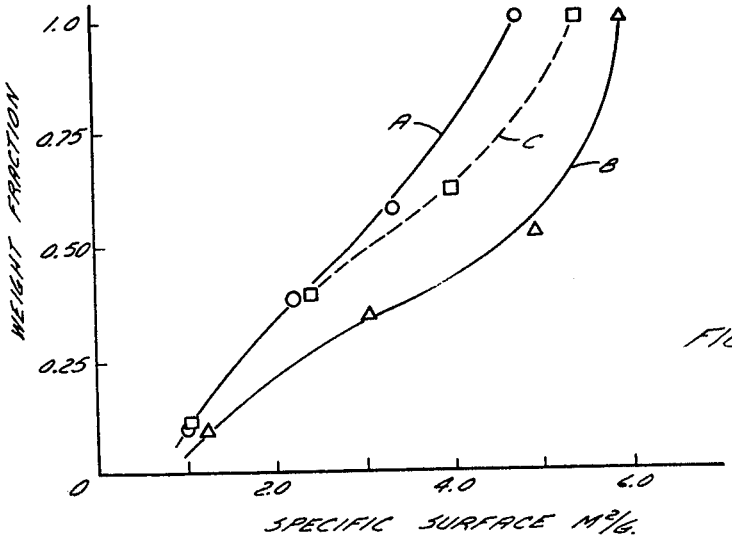
FIG. 4 shows a comparison between the specific surface distribution in a thermo-mechanical pulp before and after treatment in accordance with the present invention, FIGS. 5 *a, b,* and *c* illustrate schematically methods of fractionating on the basis of specific surface by means of systems of hydrocyclones.

FIG. 4 shows the specific surface distribution of, respectively a pulp directly from a refiner, a pulp treated according to the present invention and one of the prior art. Curve A indicates the specific surface distribution for pulp as discharged from the refiner (before screening and cleaning, line 12 of FIG. 1), curve B indicates the pulp to the paper machine when treated according to the present invention, and curve C is the pulp to the paper machine when treated according to a conventional process. The data for these curves is provided in Table 1.

TABLE I

| PULP SAMPLE | AVERAGE SPECIFIC SURFACE $m^2/g$ Conventional Process 3% hydrocyclone underflow and 10% Screen rejects | Present Invention 14% hydrocyclone underflow and 10% Screen rejects |
|---|---|---|
| Refiner Discharge (before screening and cleaning) (line 12, FIG. 1) | 4.8 | 4.8 |
| Screen Rejects (line 21, FIG. 1) | 1.6 | 1.6 |
| Underflow fraction (line 22, FIG. 1) | 0.9 | 1.2 |
| Total Rejects - Before Refining (Press 23, FIG. 1) | 1.5 | 1.3 |
| Rejects - After Refining (line 24, FIG. 1) | 6.7 | 6.2 |
| Centricleaner Accepts (line 17, FIG. 1) | 5.2 | 5.8 |
| Pulp to Papermachine | 5.4 | 5.9 |
| Linting Propensity Index of pulp to the machine (weight fraction of specific surface of 2.5 $m^2/g$ or less) | 0.41 | 0.28 |
| Paper Linting Index (Curve A FIG. 3) | 62 | 47 |

It will be seen that in this example the original pulp had close to 50% of fibres with a specific surface of 2.5 or less and that by separating only 14% of the pulp in the cyclone and mechanically processing the percentage of fibres with such a low specific surface is reduced about 28% in the pulp to the machine. This reduced the linting index of the paper significantly (from 62 to 47) Curve C represents the specific distribution of a pulp obtained from pulp A by separating from said pulp in a cyclone an underflow fraction of about 3% and processing this fraction in the refiner. It is apparent that no substantial reduction in the quality of fiber with a specific surface below 2.5 (linting candidate material) is obtained.

In those applications where the amount of energy is to apply to the pulp is to be held to a minimum, stock in line 14 would be further screened with the rejects of the screen containing the major portion of fibers longer than 1 mm being transmitted directly (with suitable conventional cleaning) to the paper machine while the accepts which would include a significant portion or preferably substantially all of the fibers having a fiber length less than about 1 mm would pass into the hydrocyclone 15 and be separated on the basis of specific surface into a high specific surface fraction which would pass to the paper machine as shown and a low specific surface fraction that would be passed to the hydrocyclone 16 and eventually to the refiner 20 where further energy would be applied and the refined fraction would then be added to the other stock proceeding to the paper machine.

No method for readily obtaining specific surface distribution of a pulp is available and therefore it was necessary to develop a method of fractionating pulp into fractions each of which has a relatively narrow range of specific surface. Hydrocyclones have been found to provide an appropriate means for separating fractions of pulp of relatively narrow specific surface distribution. Conventional methods of measuring specific surface are relatively complicated. There is however, a correlation between the measurements of specific surface and freeness for a wide range of these two properties (correlation is not 100% accurate and there may be significant deviation if the pulp properties vary widely). Thus while the basic criteria for characterizing the linting propensity is fractional distribution according to specific surface, in practice, the freeness value may also be used instead of the inverse relationship of specific surface to freeness.

Figure 5A:
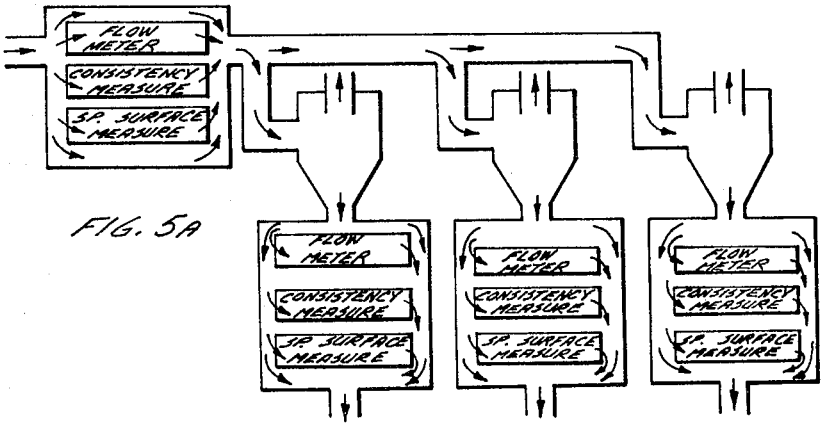
Figure 5B:
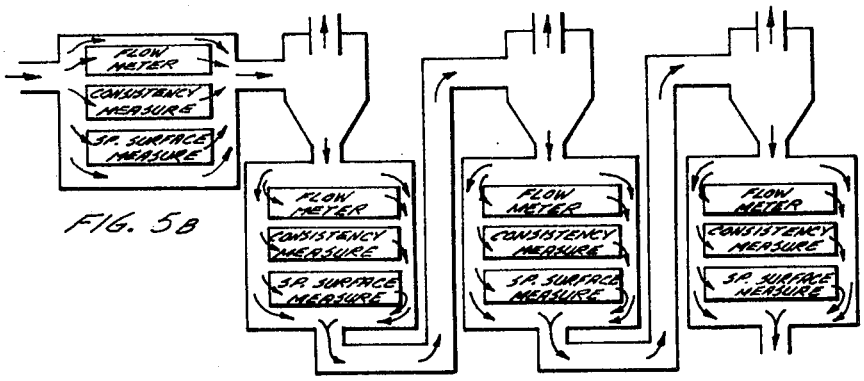
Figure 5C:
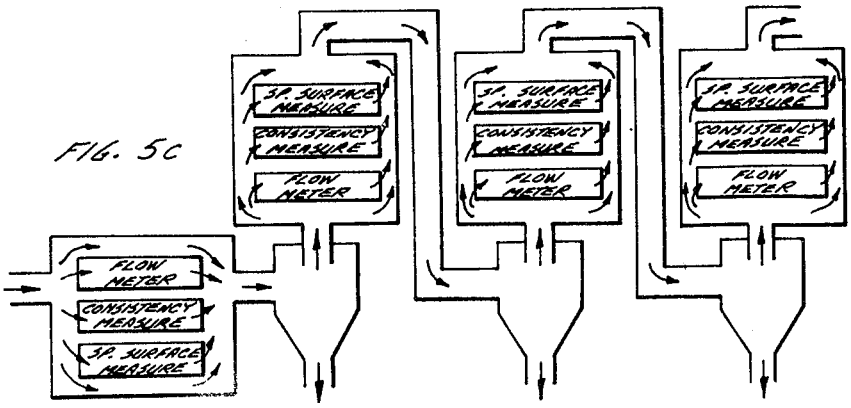

Several arrangements of hydrocyclones may be used to fractionate pulps by specific surface, for example, parallel arrangements as illustrated in FIG. 5A, underflow cascade arrangement as illustrated in FIG. 5B, and an overflow cascade arrangement as illustrated in FIG. 5C.

In each of these arrangements the cyclones will be designed to reject different fractions, for example in a parallel arrangement as illustrated in FIG. 5A for a 2 inch diameter cyclone the apex outlets cyclone may be 10/32 inc., 7/32 in. and 5/32 in. which will provide underflow fractions of about 60% to 40% and 12%.

The cascading arrangements shown in FIGS. 5B and 5C wherein the underflow or overflow fraction of the first cyclone becomes the feed to the second, similarly the flow from the second becomes the feed to the third and so on step by step down the line provide a narrow fractionation on the basis of specific surface.

In order to obtain the reading of the specific surface, e.g. in FIG. 5A, the flow from the apex of each of the cleaners is measured, consistency of the underflow is measured and the specific surface is measured. As indicated above, freeness values may measure instead of specific surface, keeping in mind, however, the limitations on the correlation between specific surface and freeness.

In FIG. 5B, the specific surface distribution is determined by measuring the rate, consistency, and specific surface (or, with the above reservations, freeness) of the underflows from each of the cleaners, while the index of the specific surface distribution with the arrangement shown in FIG. 5C is obtained by measuring the flow, consistency and specific surface of the overflow of each of the cleaners. Obviously, in each of the systems the flow, consistency and specific surface of the whole pulp is measured before it is fed to the cleaners.

It has been found that these arrangements provide adequate indication of the specific surface distribution of the given pulp.

In using the equipment of FIG. 5, the flow to the cleaners should be at low consistency say about 0.15%.

It will be understood that various modifications may be made without departing from the scope of the invention as defined in the appended claims.

We claim:

1. A process for producing a mechanical pulp comprising;

generating a mechanical pulp from wood material, screening said mechanical pulp into a through fraction and a retained fraction, fractionating by hydrocyclone means substantially all of said through fraction into an underflow fraction containing between about 15 and 70% of said through fraction and having an average specific surface less than the pre-determined value between 1.2 and 4 $m^2/g$ and an overflow fraction having an average specific surface greater than said underflow fraction, subjecting said underflow fraction to a mechanical processing thereby to form a processed fraction having an increased average specific surface value between 4 and 10 $m^2/g$, combining said processed fraction and overflow fraction into combined pulp having a significantly lower linting propensity than said generated mechanical pulp.

2. The process of claim 1 wherein said underflow fraction constitutes between 25 and 50% of said through fraction.

3. The process of claim 1 wherein said mechanical pulp is fractionated so that said underflow fraction has an average specific surface less than a predetermined value between 1.5 and 4 $m^2/g$.

4. The process of claim 1 wherein said processed fraction has an average specific surface at least equal in value to that of said overflow fraction.

* * * * *